US006044952A

United States Patent [19]

Haggerty et al.

[11] Patent Number: 6,044,952

[45] Date of Patent: Apr. 4, 2000

[54] MULTI-FUNCTION OPTICAL SENSOR FOR A DOCUMENT ACCEPTOR

[75] Inventors: Chad C. Haggerty; Patrick J. McGarry; Edward M. Zoladz, Jr., all of West Chester, Pa.

[73] Assignee: Mars, Incorporated, McLean, Va.

[21] Appl. No.: 09/080,529

[22] Filed: May 18, 1998

[51] Int. Cl.[7] ..... G07D 7/20

[52] U.S. Cl. ..... 194/207; 250/556

[58] Field of Search ..... 194/203, 207; 250/556

[56] References Cited

U.S. PATENT DOCUMENTS

| | | | |
|---|---|---|---|
| 4,658,125 | 4/1987 | Kachi et al. | 235/449 |
| 4,809,837 | 3/1989 | Hayashi | 194/205 |
| 5,091,634 | 2/1992 | Finch et al. | 235/375 |
| 5,222,584 | 6/1993 | Zouzoulas | 194/207 |
| 5,290,033 | 3/1994 | Bittner et al. | 194/206 X |
| 5,304,813 | 4/1994 | DeMan | 250/556 |
| 5,420,406 | 5/1995 | Izawa et al. | 235/379 |
| 5,547,061 | 8/1996 | Itako et al. | 194/203 |

FOREIGN PATENT DOCUMENTS 0 720 128 A2 7/1996 European Pat. Off. .

*Primary Examiner*—F. J. Bartuska
*Attorney, Agent, or Firm*—Fish & Richardson P.C.

[57] ABSTRACT

A document acceptor includes a document transport path and a multi-function optical sensor disposed adjacent the document path. The multi-function sensor can be operated in one of two or more modes. Depending on the mode in which the sensor is operated, signals from the sensor can be used, for example, to indicate whether a document has reached a particular position, to determine whether the document includes a predetermined pattern, such as a bar-code pattern, or to determine whether an attempt is being made to pull the document out of the acceptor.

49 Claims, 13 Drawing Sheets

| MODE OF SENSOR 52 | STATE OF BAR-CODE LED 54 | STATE OF POSITIONING SENSING LED 58 | OPTICAL RECEIVER OUTPUT |
|---|---|---|---|
| 1. ESCROW | OFF | ON | SEND TO MICRO-CONTROLLER VIA VARIABLE GAIN AMPLIFIER 86 AND ADC 88 |
| 2. BAR-CODE SENSE | ON | OFF | SEND TO MICRO-CONTROLLER VIA BAR-CODE PATTERN/ DISCRIMINATION CIRCUITRY 108 |
| 3. ANTI-CHEAT | OFF | ON | SEND TO MICRO-CONTROLLER VIA AN INTERRUPT LINE (109 OR 114) |

*FIG. 12*

MULTI-FUNCTION OPTICAL SENSOR FOR A DOCUMENT ACCEPTOR

RELATED APPLICATIONS

This invention is related to U.S. patent application Ser. No. 08/941,400, now U.S. Pat. No. 5,855,268 entitled "Optical Sensor System For A Bill Validator" and assigned to the assignee of the present invention. That application is incorporated herein by reference in its entirety.

BACKGROUND

The invention relates generally to a document acceptor with a multi-function optical sensor.

Document acceptors, such as bill acceptors and bill validators, typically include one or more sensors. For example, various bill validators include multiple sensors. Each such sensor typically may perform one of the following functions: detecting the insertion of bills or other documents into the validator, detecting optical and/or magnetic features of an inserted banknote, detecting bar code patterns on an inserted document, and detecting the position of a document within the validator, among others. As vendors demand better capabilities for distinguishing between genuine and false documents, as well as increased security and prevention of fraud, the number of sensors required in bill validators tends to increase. Each additional sensor, however, takes up space within the validator and increases the overall cost of the validator.

SUMMARY

In general, a document acceptor includes a multi-function sensor which can be operated in one of two or more modes. Depending on the mode in which the sensor is operated, signals from the sensor can be used, for example, to indicate whether a document has reached a particular position along a document path, whether the document includes a predetermined pattern, such as a bar-code pattern, or whether an attempt is being made to pull the document out of the acceptor. Other functions also are possible in particular implementations.

In one aspect, a document acceptor includes a document transport path and an optical sensor disposed adjacent the document path. The optical sensor includes at least first and second light emitting devices and an optical receiver. The optical receiver receives optical signals originating from the first light emitting device when the sensor is operated in a first mode, and receives optical signals originating from the second light emitting device when the sensor is operated in a second mode.

The acceptor also includes a controller for operating the sensor in at least either the first mode or the second mode and for processing signals received from the sensor. When the sensor is operated in the first mode, electrical signals originating from the optical receiver are used to determine an absence or presence of the document at a position along the path. When the sensor is operated in the second mode, signals originating from the optical receiver are indicative of whether the document includes a predetermined pattern, such as a bar-code or other pattern.

In some implementations, the sensor also can be operated in a third mode in which electrical signals from the optical receiver are used to determine whether the document is moving away from a storage location in the acceptor. The third mode can be used to detect attempts to cheat a system, for example, by pulling a document out of the acceptor after obtaining credit.

The sensor is not limited to the use of multiple discrete light emitting devices. In some implementations, a single integrated device having multiple light emitting components can be used. In other implementations, a single light emitting device can be used in conjunction with one or more optical receivers to achieve the various functions of the sensor.

In another aspect, a method of accepting a document includes causing the document to move along a transport path and sensing a leading edge of the document as it moves along the path using an optical sensor operating in a first mode. The optical sensor is controlled to operate in a second mode after the leading edge of the document is sensed. Data indicative of whether the document includes a predetermined pattern, such as a bar-code or other pattern, is obtained based on signals sensed by the optical sensor while operating in the second mode.

If a document is accepted as genuine, then in some implementations, the sensor can subsequently be operated in an anti-cheat mode while the document is transported toward a storage location.

One or more of the following advantages may be present in some of the implementations. By providing a single optical sensor that can operate in multiple modes and, therefore, perform multiple functions, the acceptor can be manufactured at a lower cost. Similarly, the acceptor can be kept relatively compact by limiting the number of sensors required even as the capabilities of the acceptor increase. The multi-functional sensor also can increase the flexibility and versatility of a bill acceptor by providing the added ability to sense and authenticate documents with bar-code or other patterns. The design of the multi-functional sensor also can help prevent the overall design of the acceptor from becoming too complex.

Other features and advantages will be apparent from the following description, accompanying drawings and claims.

BRIEF DESCRIPTION OF THE DRAWINGS

FIG. 12 is a table summarizing various states of the multi-function sensor according to the invention.

DETAILED DESCRIPTION

Figure 1:
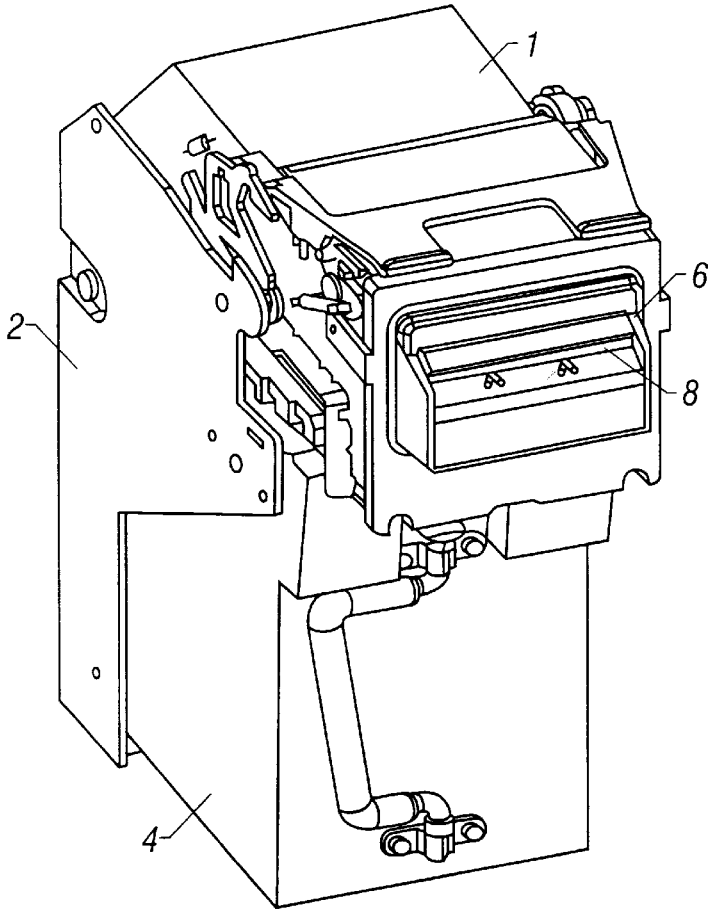
FIG. 1 is a perspective view of a document acceptor and transport unit.
Figure 2:
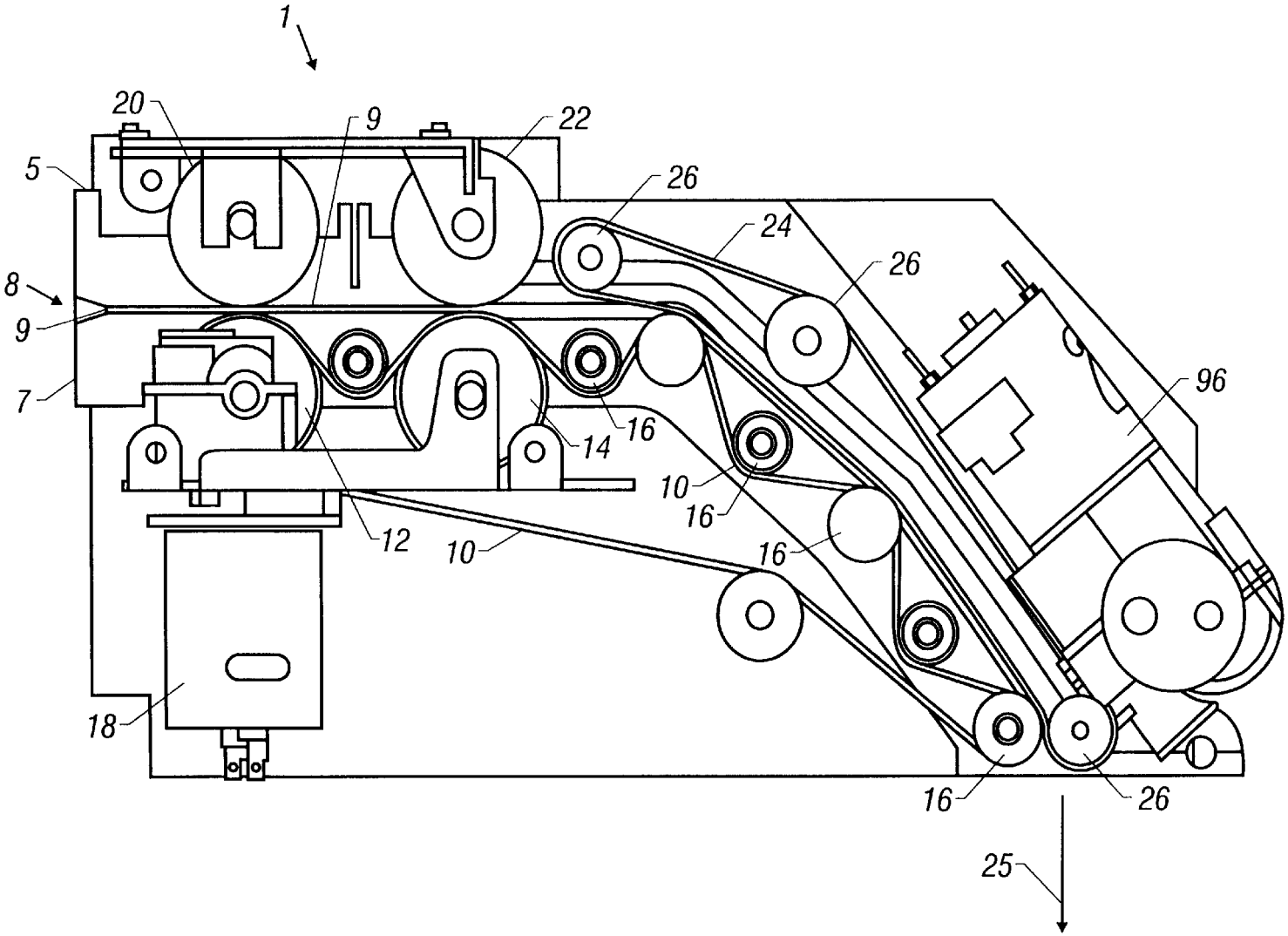
FIG. 2 is an enlarged side view of the interior of the document acceptor and transport system of FIG. 1.

Referring to FIGS. 1 and 2, a document acceptor and transport unit 1 is connected to a document stacker 2 and cashbox 4. The term "document" as used herein includes any paper currency, bill, banknote, bar-coded coupon or other security note which may be used in exchange for goods or services. In the illustrated implementation, the unit 1 also is capable of validating documents, and, therefore, can be referred to as a document validator and transport unit.

The validator and transport unit 1 has a bezel 6 designed to fit through an aperture in the front panel of a vending machine, a gaming machine such as a slot machine, or the like. A document entryway 8 is incorporated in the bezel for the insertion of a document.

The document entryway 8 leads to a document transport path or passageway 9. The beginning of the passageway 9 is defined by an upper housing 5 and a lower housing 7. Disposed on the bottom of the passageway 9 is a set of continuous belts 10 (one on each side of the passageway) which fit through openings (not shown) in the lower housing 7 to contact a document. The belts 10 are connected to a drive wheel 12, a pulley wheel 14 and various other tension wheels 16. A reversible transport motor 18 is connected by a series of gears (not shown) to the drive wheels 12. Pulley wheels 20, 22 are located on the top of the bill passageway which fit through openings in the upper housing 5 and are opposite the drive wheel and pulley wheel 14. In addition, a pair of continuous transport belts 24 are connected to tension wheels 26 on the top of the passageway 9.

In general, a document 29 (FIG. 3) is inserted in the direction of arrow 28 to be transported past front optical sensors 40–50. When a banknote or other document is inserted into the validator and transport unit 1, one or more start sensors 40, 42 cause the transport motor 18 (FIG. 2) to start. The document is gripped between the belts 10 and wheels 20 and advanced through the passageway 9 to encounter one or more front optical recognition sensors 44, 46, 48 and 50. The recognition sensors 44–50 are located along the passageway 9 to generate electrical signals in response to features of a bill. The start sensors 40, 42 and the optical recognition units 44–50 are comprised of transmitters (for example, light emitting diodes or LEDs) and receivers (such as phototransistors) positioned in the upper housing 5 and lower housing 7 on opposite sides of the passageway 9 near the entryway 8. The optical sensors 40–50 used in the validator apparatus can be encased in the upper and lower housings to prevent dirt and other foreign matter from adhering to the sensors, and to prevent tampering. The upper and lower housings can be made of transparent plastic, such as a red transparent plastic material having optical characteristics which permit the unobstructed transmission of optical waves in the red and infrared portions of the spectrum.

Another sensor 52 is disposed adjacent the transport path 9 and is located in the upper and lower housings between the pulley wheels 20 and 22. As described in greater detail below, the sensor 52 can be operated in several modes, including an escrow mode, a bar-code sense mode, and an anti-cheat mode. Generally, when in the escrow mode, the sensor 52 can be used to sense the leading edge 30 and/or the trailing edge 32 of a document 29 as it is transported through the validator and transport system 1. The sensor 52, therefore, can provide information about the position of the document 29 in the system 1. When in the pattern sensing or bar-code sense mode, the sensor 52 can be used to sense a predetermined pattern 34 on the document 29. The predetermined pattern 34 can include, for example, a pattern embedded in or printed on the document 29. In one particular application, the predetermined pattern 34 can be a bar-code or similar pattern. The collected data then can be used to decode the pattern 34. When in the anti-cheat mode, the sensor 52 can be used, for example, to confirm the location of the document 29 in the system 1 and to detect a vandal's attempt to pull the document 29 out of the validator through the entryway 8.

Figure 3:
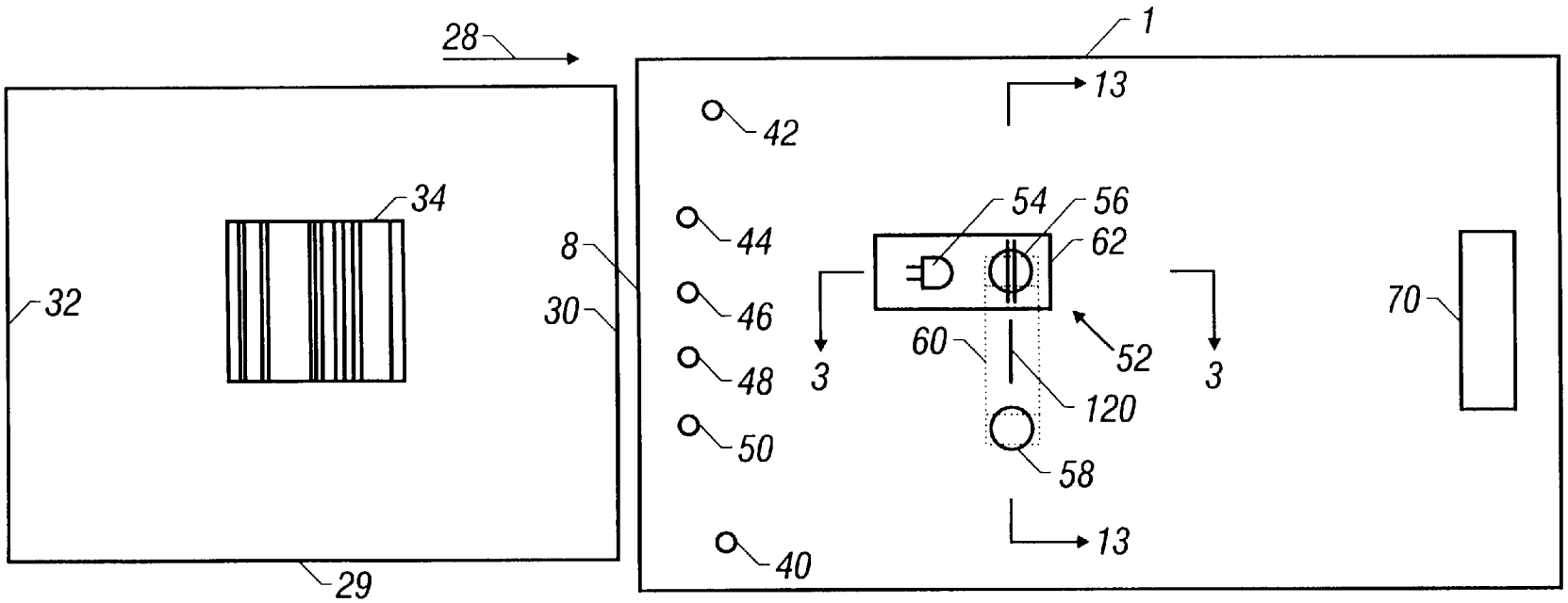
FIG. 3 is a simplified top view, according to the invention, showing various sensors in the document acceptor and transport unit of FIG. 2.
Figure 4:
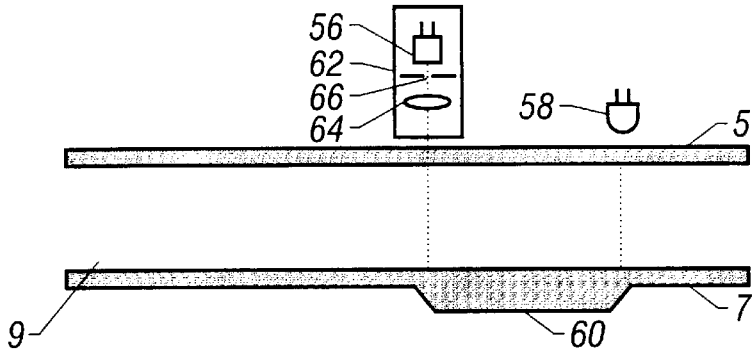
FIG. 4 is a cross-sectional view of a multi-function sensor taken along lines 13—13 in FIG. 3.
Figure 5:
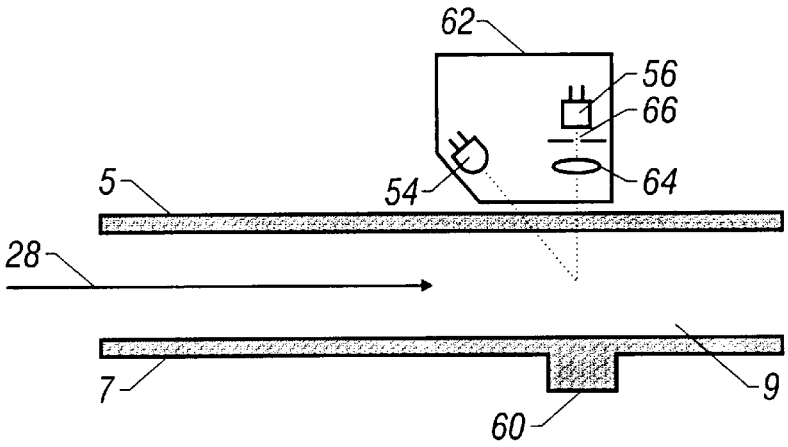
FIG. 5 is a cross-sectional view of the multi-function sensor taken along lines 3—3 in FIG. 3.

In one implementation, the sensor 52 includes first and second light emitting devices, such as light emitting diodes (LEDs) 54, 58, and an optical receiver 56 disposed on one side of the document path 9 (FIGS. 3–5). In the illustrated implementation, the LEDs 54, 58 and the optical receiver 56 are located within the upper housing 5. The first LED 54 is referred to as a pattern sensing or bar-code LED, whereas the LED 58 is referred to as a position sensing LED.

In one implementation, the bar-code LED 54 emits light in the visible range of the optical spectrum, for example, red light at approximately 660 nanometers (nm), and is inclined, for example, at approximately a 45 degree angle with respect to the document path 9. A lens 64 and a slit 66 (see FIG. 4) are disposed within the upper housing 5 between the bill path 9 and the optical receiver 56, with the slit 66 positioned between the lens 64 and the optical receiver 56. The optical receiver 56 can be, for example, a phototransistor, a photodiode, or some other light detector. In one implementation, the bar-code LED 54, the optical receiver 56 and the associated lens 64 and slit 66 are disposed within a plastic package 62, such as an OTR490 bar code optic head device, available from Opto Technology, Inc. In the illustrated implementation, the position sensing LED 58 emits light in the infrared range of the optical spectrum. For example, a TLN119 device, commercially available from Toshiba, can be used as the position sensing LED 58.

The optical receiver 56 and the position sensing LED 58 are substantially aligned with one another so that they are approximately the same distance from the entryway 8. In one implementation, the optical receiver 56 and the position sensing LED 58 are located about 3 inches from the start sensors 40, 42.

Figure 6:
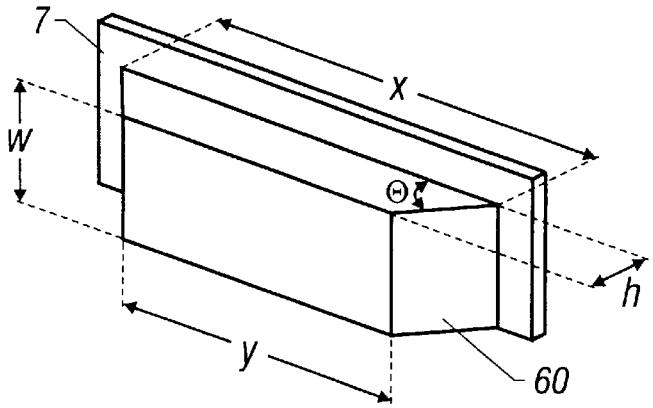
FIG. 6 shows an exemplary prism that can be used in the multi-function sensor.

In the implementation of FIGS. 3–5, a prism 60 is located on the opposite side of the document path 9 within the lower housing 7. The longest side of the prism 60 is substantially perpendicular to the direction of travel 28 of the document 29. One end of the prism 60 is positioned substantially opposite the lens 64; the other end of the prism is positioned substantially opposite the position sensing LED 58. In the illustrated implementation (see FIG. 6), the prism 60 has an upper surface which is substantially parallel to the document path and has a length x of about 15 millimeters (mm). The lower surface of the prism, which is substantially parallel to the upper surface, has a length y of about 10.3 mm. As shown in FIG. 6, the prism 60 has a height h of about 2.4 mm and a width w of about 4.3 mm. Two sides of the prism 60 are inclined at an angle $\theta$ of approximately 45° so that a cross-section of the prism is trapezoidal shaped. The prism 60 can be made of a material such as polycarbonate LEXAN 141, although other materials may be suitable for particular applications.

In general, when the bar-code LED 54 emits light and a document travels along the document path 9 between the sensor 52 and the prism 60, light from the bar-code LED is reflected from the document 29 and sensed by the optical receiver 56. When the position sensing LED 58 emits light, light from the position sensing LED is transmitted across the passageway 9 to the prism 60. The transmitted light is reflected by the prism 60 and re-directed upward across the document path 9 and toward the lens 64 to be sensed by the optical receiver 56. Thus, light from the position sensing LED 58 crosses the document path 9 twice before being sensed by the optical receiver 56.

Another optical sensor 70 (FIG. 3), which can include a LED-phototransistor pair, is positioned further along the passageway 9 and also can be used to sense the leading and trailing edges 32 of the document 29. The LED-phototransistor pair associated with the sensor 70 can be disposed on one side of the passageway 9, for example, in the lower housing 7 with a prism across the document path. In one implementation, the sensor 70 is positioned approximately six inches from the prism 60.

Figure 7:
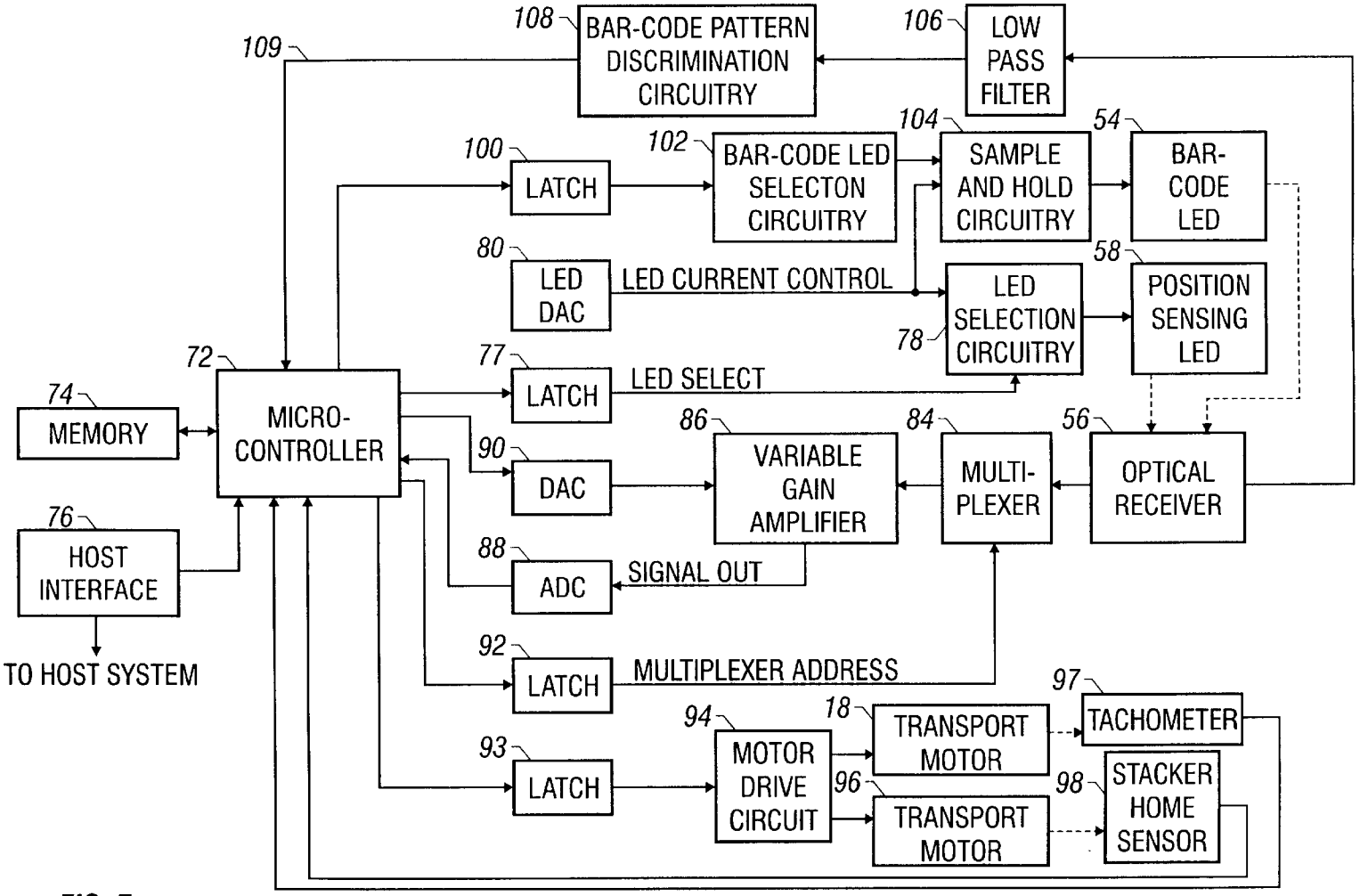
FIG. 7 is a simplified partial block diagram of a acceptor and transport system according to the invention.

Referring to FIG. 7, a microcontroller 72 is connected to a memory 74, which can include electrically erasable programmable read only memory (EEPROM) and flash memory, for storing values associated with system calibration, signal processing and system software. The microcontroller 72 processes signals which are used to determine the authenticity of an inserted document, and transmits information such as credit data, hardware error messages, in-service and out-of-service messages and the like to a host system through host interface 76.

In general, the microcontroller 72 controls the LEDs through LED selection circuitry 78 and through bar-code LED selection circuitry 102. The selection circuitry 78 is used to control the position sensing LED 58. Selection signals are provided to the selection circuitry 78 via a 8-bit latch 77. The microcontroller 72 also provides drive current through LED digital-to-analog converter (DAC) 80 for driving a selected one of the LEDs. The LED current control signals provided to the LED DAC can be, for example, 0-volt or 5-volt binary-level signals.

The microcontroller 72 provides signals through a latch 100 to the selection circuitry 102 to control the bar-code LED 54. The output signal from the bar-code LED selection circuitry 102 as well as the output signal from the LED DAC 80 are provided to a sample and hold circuit 104 which directly controls the flow of current through the bar-code LED 54. The output signals from the bar-code LED selection circuitry 102 indicate to the sample and hold circuitry 104 when to sample the output signal from the LED DAC 80 and when to hold the sampled signal so that the value of the sampled signal can be provided to the bar-code LED 54. In this manner, a relatively stable optical signal can be provided when the bar-code LED 54 is in the ON state.

Generally, when the sensor 52 is operated in the bar-code sense mode, the bar-code LED 54 is switched to an ON state to emit light, and the position sensing LED 58 is in an OFF state. Conversely, when the sensor 52 is operated in either the escrow mode or the anti-cheat mode, the position sensing LED 58 is switched to an ON state to emit light, and the bar-code LED 54 is in the OFF state (see FIG. 12).

Figure 8:
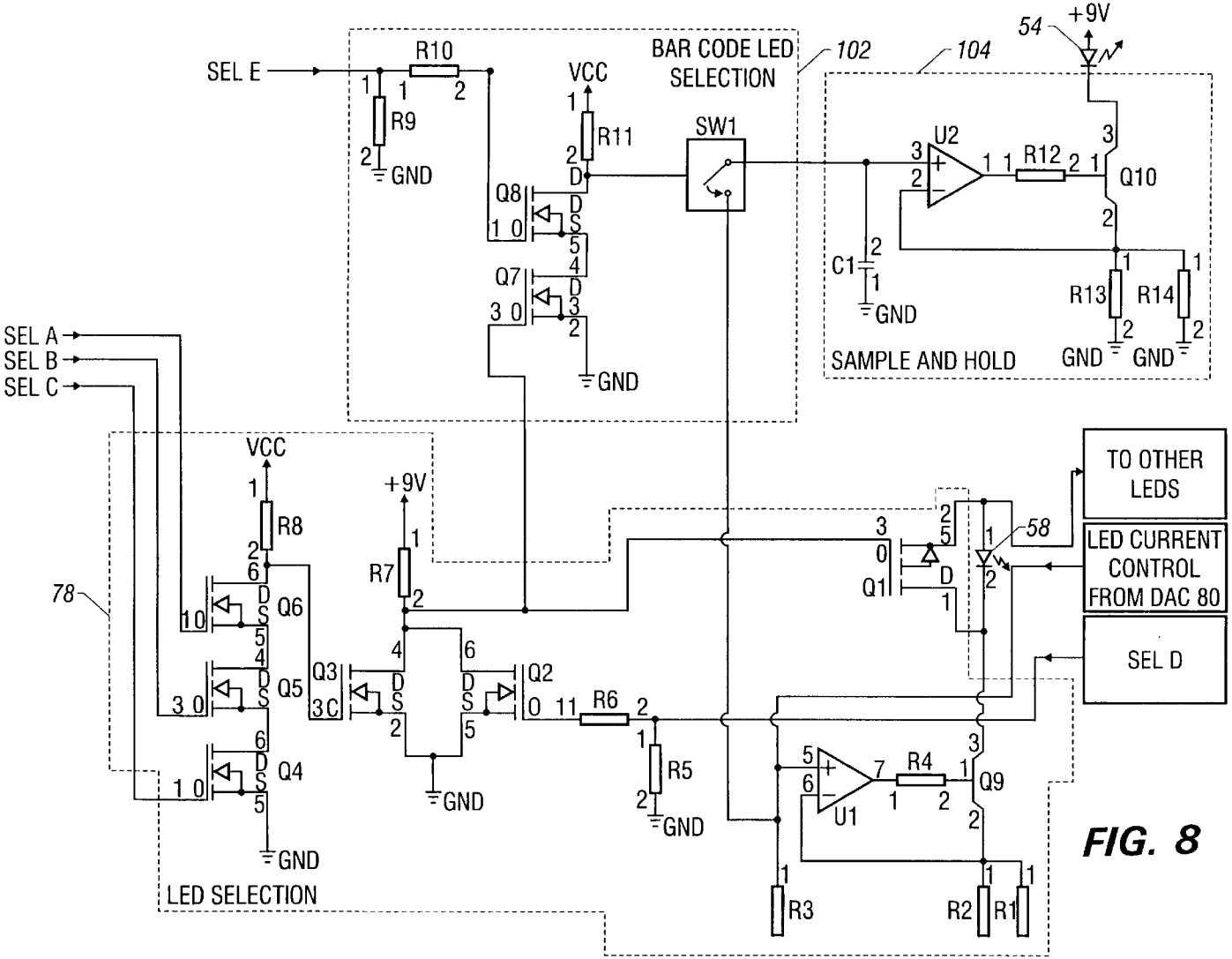

One implementation of the circuitry for controlling the states of the position sensing LED 58 and the bar-code LED 54 is illustrated in FIG. 8. The microcontroller 72 provides several control signals, including SEL A, SEL B, SEL C, SEL D and SEL E, which control the states of the LEDs. In the LED selection circuitry 78, transistors Q4, Q5 and Q6 function as a three-input NAND gate. Similarly, transistors Q2 and Q3 function as a two-input NOR gate. Thus, for example, when control signals SEL A, SEL B and SEL C are at a digital high level, the signal on the gate of transistor Q3 is at a digital low level. If the control signal SEL D also is at a digital low level, then the transistor Q1 turns OFF to allow the position sensing LED 58 to emit light. The amplifier U1, the transistor Q9, and the resistors R1 through R4, form a current source whose amplitude is controlled by the value of the voltage provided from the DAC 80. The current source controls the amplitude of the light emitted from the position sensing LED 58. Additional circuitry for controlling selection of the start sensors 40, 42 or the recognition sensors 44–50 is described, for example, in U.S. patent application Ser. No. 08/941,400, referred to above.

In the illustrated implementation, the signal SEL E is used in conjunction with the other control signals to control the state of the bar-code LED 54. Referring to the bar-code selection circuitry 102 in FIG. 8, the transistors Q7 and Q8 function as a two-input NAND gate. Thus, when the signals SEL A, SEL B, SEL C and SEL E are at a digital high level, and SEL D is at a digital low level, the signal at the drain of transistor Q8 is at a digital low level. The low level signal on the drain of Q8 causes the switch SW1 to close so that the sample and hold circuit 104 is coupled electrically to the LED current control signal from the DAC 80. When the sample and hold circuit 104 is coupled to the signal from the DAC 80, the capacitor C1 charges to a voltage based on the signal provided by the DAC 80. The charge stored by C1 then determines the level of light emission from the bar-code LED 54.

Once the capacitor C1 has been charged to the desired level, the signal SEL E can be changed to a digital low signal, so as to cause the switch SW1 to open and disconnect the sample and hold circuit 104 from the output signal from the DAC 80. Alternatively, the state of one of the other signals SEL A, SEL B, SEL C or SEL D, can be changed to disconnect the sample and hold circuit 104 from the DAC output signal. The output signal from the DAC 80 then can be used to control the amplitude of optical signals from the other LEDs without affecting the optical signal from the bar-code LED 54. Thus, the sample and hold circuit 104 helps provide an optical signal from the bar-code LED 54 having a relatively constant brightness throughout the duration of a bar-code scan.

Returning to FIG. 7, if the position sensing LED 58 is selected and energized, the optical receiver 56 generates an electrical signal which is received by the micro-controller 72 through multiplexer 84, variable gain amplifier 86, and a twelve-bit analog-to-digital converter (ADC) 88. The micro-controller selects the photoreceiver of interest, in this case the optical receiver 56, by specifying an address through latch 92 to multiplexer 94. The control signals SEL A, SEL B and SEL C can be used to specify the address to the multiplexer 84. For example, in the illustrated implementation, when the signals SEL A, SEL B and SEL C are at a digital high level, the multiplexer 84 allows the output from the optical receiver 56 to pass to the variable gain amplifier 86.

The microcontroller 72 also controls the gain of the variable gain amplifier 86 through a digital to analog converter (DAC) 90. In one implementation, the control signal SEL E also can be used to choose between two possible gains. Further details of a suitable variable gain amplifier 86 are described in the previously mentioned U.S. patent application Ser. No. 08/941,400.

Figure 9:
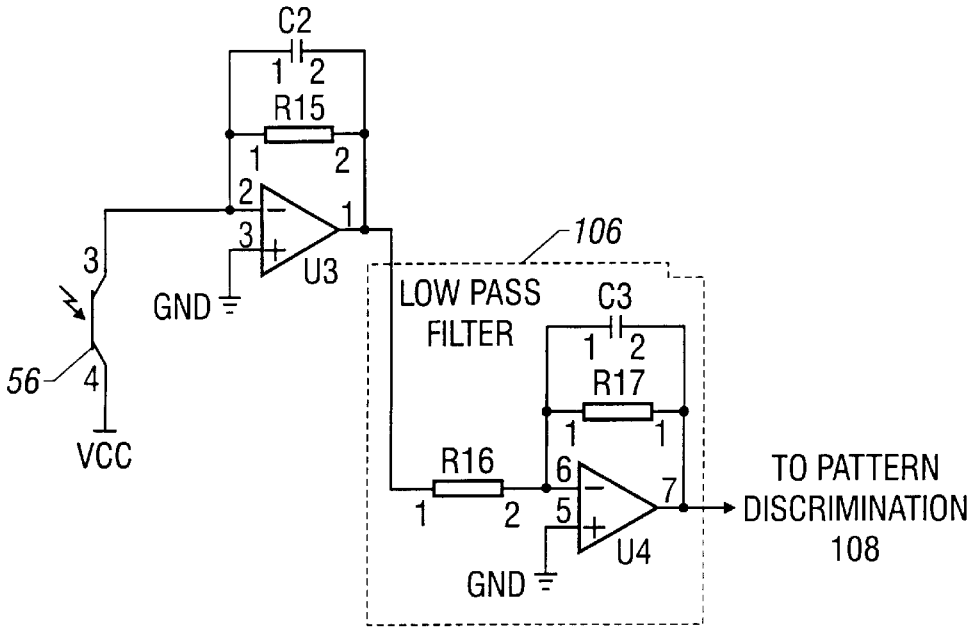
FIGS. 8–10 are exemplary circuit diagrams according to the invention.
Figure 10:
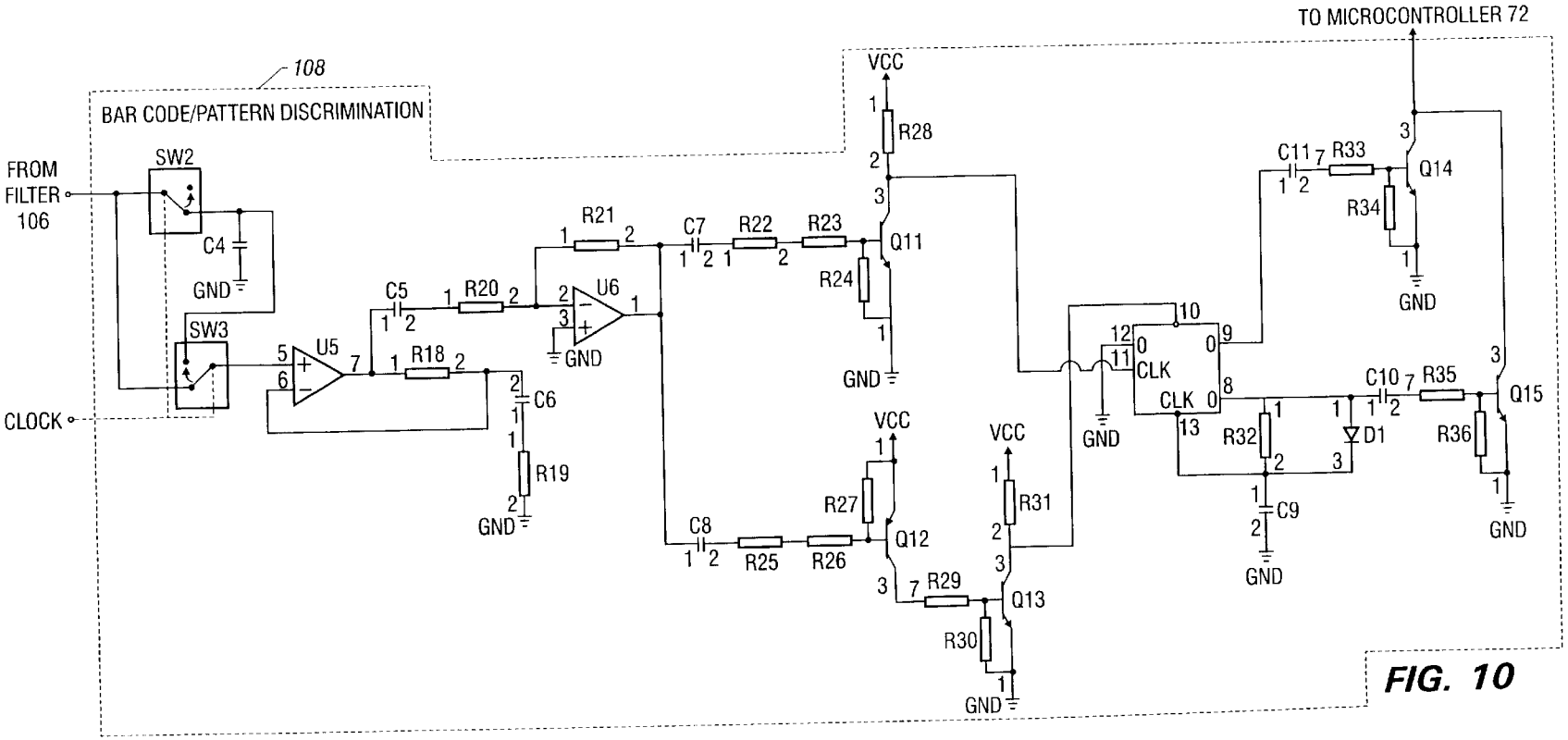

If the bar-code LED 54 is selected and energized, the optical receiver 56 generates an electric signal which is received by the microcontroller 72 through a low pass filter 106 (FIGS. 7 and 9) and bar-code or pattern discrimination circuitry 108 (FIGS. 7 and 10). When a bar-code pattern is sensed by the sensor 52, output signals from the optical receiver 56 correspond to the transitions in the bar-code pattern. The signals corresponding to a bar-code pattern tend to be low frequency signals. Therefore, the low pass filter 106 is used to remove high frequency signals that may occur.

One implementation of the bar-code or pattern discrimination circuitry 108, illustrated in FIG. 10, includes a clocked differentiator circuit. A 10 kilohertz (kHz) clock signal (CLOCK) controls switches SW2 and SW3 to provide input signals to one input of an amplifier U5. When the switches SW2 and SW2 are in their respective downward positions, the output from the filter 106 is provided directly to the amplifier U5, and the capacitor C4 is charged. When the clock signal (CLOCK) causes the switches SW2 and SW3 to move to their respective upward positions, a delayed sample of the filter output is taken from the capacitor C4 and provided as an input to the amplifier U5. Instantaneous changes in the input to the amplifier U5 will appear as positive or negative spikes at the output of the amplifier U6 at the next transition of the switches SW2, SW3 to their respective upward positions. The amplitudes of the spikes are proportional to the derivative of the input waveform.

The pattern discrimination circuitry 108 also includes spike-to-pulse conversion circuitry which amplifies the positive and negative spikes and converts the first rising edge and the first downward edge in each series of positive or negative spikes to an approximately 100 microsecond pulse. Specifically, the output signals from the amplifier U6 are passed through transistors Q11–Q13 to yield separate pulse trains for positive and negative transitions. The separate pulse trains are provided to a D-type flip-flop 110 which changes state only when the first positive or first negative pulse in each series of positive or negative pulses is encountered. An RC circuit which includes resistor R32, capacitor C9 and diode D1 causes the flip-flop 110 output to return to a constant state after a specified period. The outputs Q and $\overline{Q}$ from the flip-flop 110 are coupled by capacitors C10, C11 to transistors Q14, Q15 which form a NOR gate. Thus, the first rising edge (or first downward edge) in each series of spikes is converted to a pulse having a duration of approximately 100 microsecond.

If the document 29 includes a bar-code pattern 34 (see FIG. 3), then each transition in the bar-code pattern, in other words, each transition from a dark area to a light area or vice-versa, will be represented by a 100 microsecond pulse produced by the pattern discrimination circuitry 108. The pulses from the pattern discrimination circuitry 108 are provided to the microcontroller 72 by an interrupt line 109.

Exemplary values of the resistors and capacitors in FIGS. 8–10 are as follows: R1 (150 Ohm), R2 (150 Ohm), R3 (5.6K Ohm), R4 (1K Ohm), R5 (47K Ohm), R6 (100 Ohm), R7 (10K Ohm), R8 (10K Ohm), R9 (47K Ohm), R10 (100 Ohm), R11 (10K Ohm), R12 (1K Ohm), R13 (150 Ohm), R14 (150 Ohm), R15 (27K Ohm), R16 (47K Ohm), R17 (470 K Ohm), R18 (1M Ohm), R19 (47K Ohm), R20 (4.7K Ohm), R21 (15K Ohm), R22 (2K Ohm), R23 (4.7K Ohm), R24 (4.7K Ohm), R25 (1K Ohm), R26 (4.7K Ohm), R27 (4.7K Ohm), R28 (10K Ohm), R29 (4.7K Ohm), R30 (4.7K Ohm), R31 (10K Ohm), R32 (470K Ohm), R33 (4.7K Ohm), R34 (4.7K Ohm), R35 (4.7K Ohm), R36 (4.7K Ohm), C1 (3.3 nF), C2 (100 pF), C3 (560 pF), C4 (67 nF), C5 (47 nF), C6 (220 pF), C7 (1 $\mu$F), C8 (1 $\mu$F), C9 (47 nF), C10 (10 nF), C11 (10 nF). Different values and other circuit designs may be suitable for particular applications.

The LED DAC 80 and gain DAC 90 are preset to appropriate settings during calibration of the start and recognition optical sensors. Calibration occurs when the validator is placed in calibration mode and white paper having transmissivity and diffusion characteristics similar to a banknote is inserted. The validator sets the gain DAC 90 to an arbitrary number (for example, 1400 out of a full scale of 4095), and adjusts the LED DAC 80 setting for the LEDs associated with the sensors 40–50, until the ADC 88 reading for that LED is equal to the arbitrary number (e.g. 1400). The setting value of the LED DAC 80 for each LED associated with the sensors 40–50 can be stored permanently in the memory 74, so that any time a given LED is turned ON its corresponding LED DAC setting is recalled and used. Alternately, the settings for the LED DAC and gain DAC can be calculated by the microcontroller 72 as the validator is used.

The position sensing LED 58 is preset to emit an optical signal whose amplitude just saturates the optical receiver 56 when the path of the emitted light is uninterrupted. In other words, when a document, such as the document 29, does not cross the path of the light emitted by the position sensing LED 58 and reflected by the prism 60, the optical receiver 56 is barely saturated. When a document, such as the document 29, is positioned in the passageway so that it interrupts the path of light emitted by the position sensing LED 58, the optical receiver 56 is no longer saturated. Thus, the position sensing LED 58 and the optical receiver 56 can be used as a switch to detect the presence or absence of a document in specified positions in the passageway 9.

The bar-code LED 54 should be calibrated to prevent signals from the optical receiver 56 from saturating the pattern discrimination circuitry 108. In one implementation, a closed-loop feedback circuit is used. For example, periodic samples corresponding to the analog signal from the optical receiver 56 can be taken while the bar-code LED 54 is turned ON. Such analog signals can be obtained by sampling output signals of the optical receiver 56 via the multiplexer 84, the variable gain amplifier 86 and the analog-to-digital converter 88. Minimum and maximum values of the sampled analog signals can be compared by the microcontroller 74 to an ideal maximum value. The amplitude of the LED current control signal then can be adjusted to correct the brightness of the optical signal from the bar-code LED 54. This technique also can be used to maintain the brightness of the bar-code LED 54 at a relatively constant level over time and to minimize the affects of ambient light.

Returning to FIG. 7, the microcontroller 72 also is coupled to the transport motor 18 and a stacker motor 96 through a latch 93 and a motor drive circuit 94. The transport motor 18 has an associated tachometer 97 for accurately monitoring the position of a document in the passageway 9. The stacker motor 96 has an associated stacker home sensor 98 for monitoring the home position of the stacker. The sensor 52 (when operated in the escrow mode), the tachometer 97 and the stacker home sensor 98 provide accurate information regarding the position of a document in the system 1.

Figure 11A:
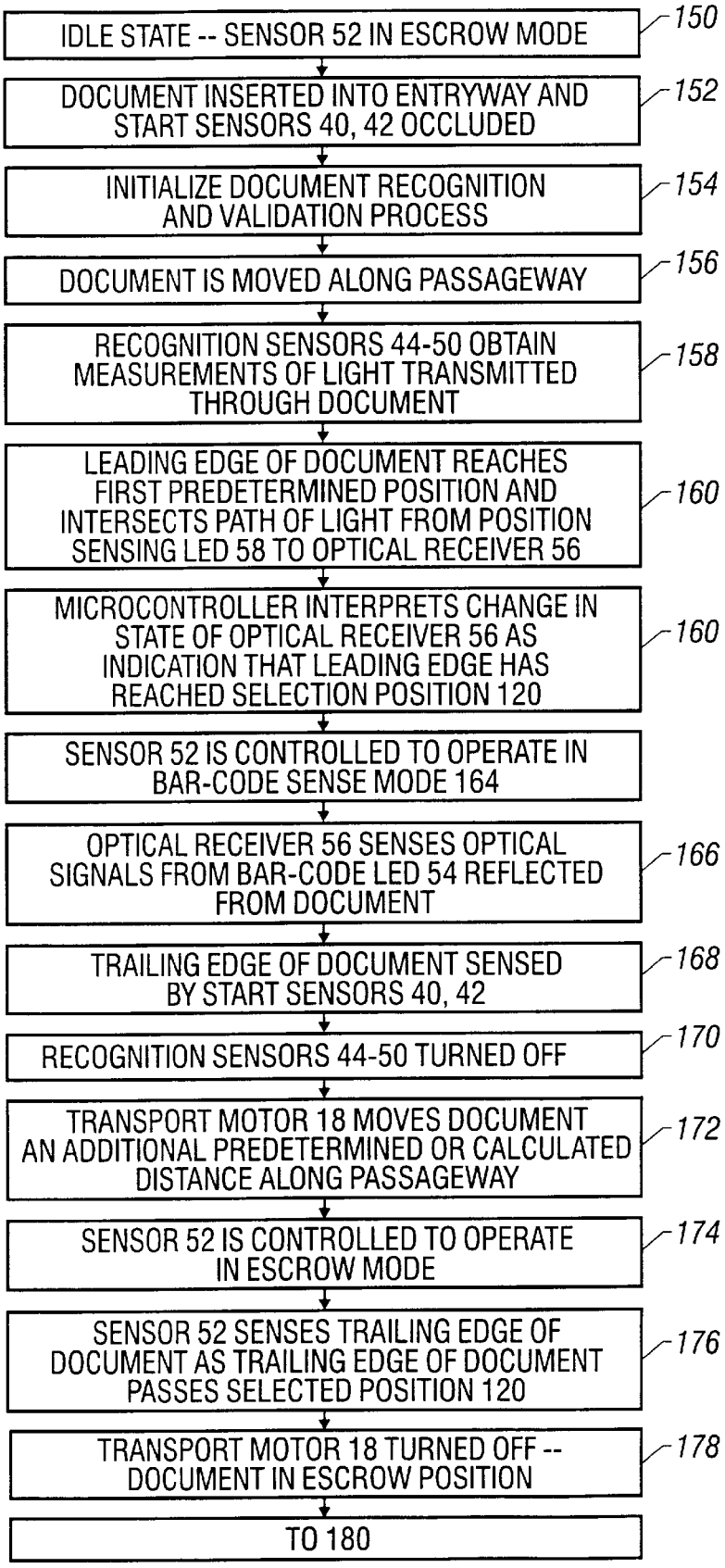
FIGS. 11A–11B are a flow chart showing a method of using a document acceptor and transport system having a multi-function sensor according to the invention.
Figure 11B:
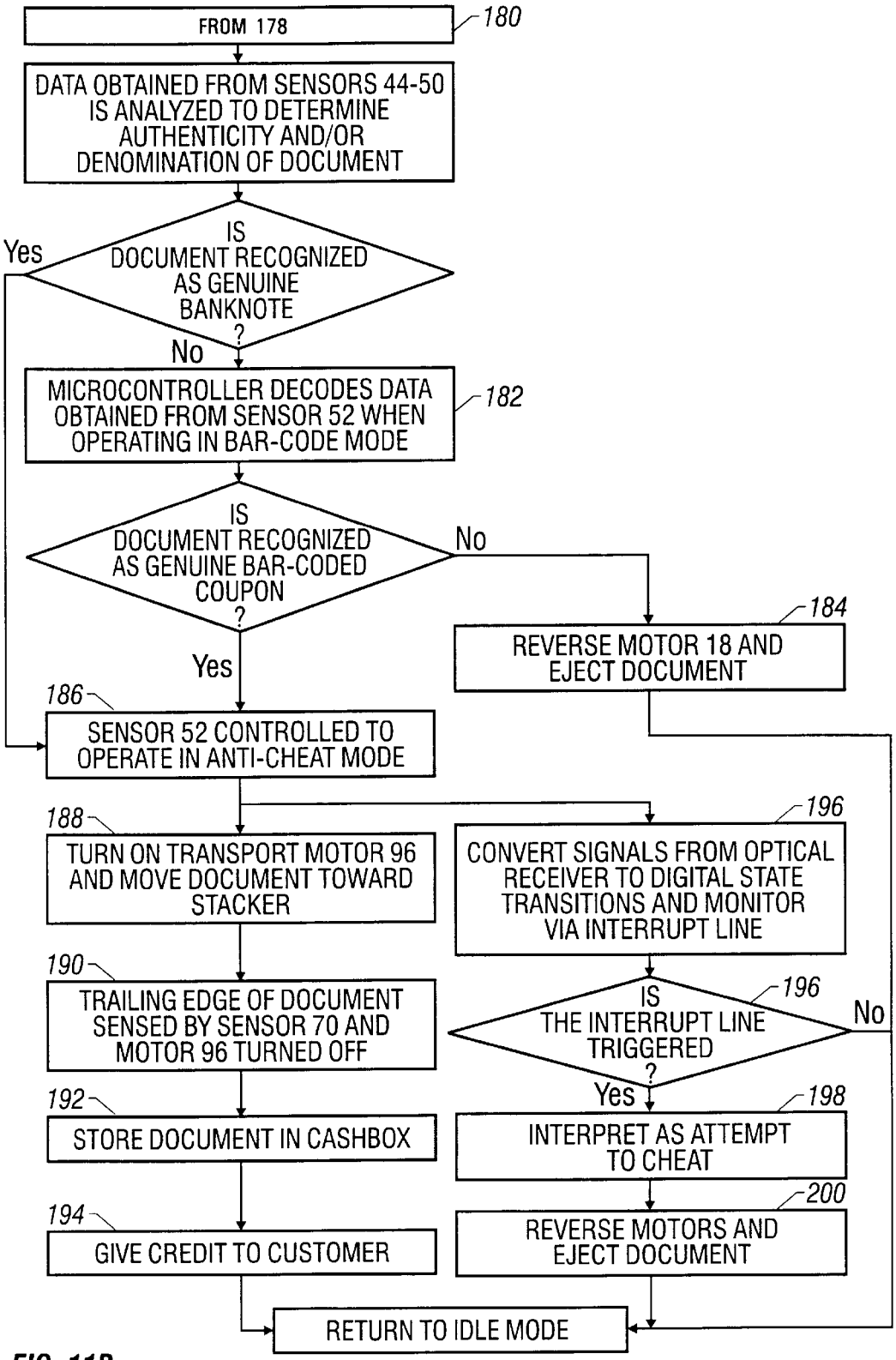

Operation of the system 1 including the multi-function sensor 52 is described with reference to FIGS. 11A–11B. Before a document is inserted into the system 1 through the entryway 8, the system is in an idle state. The sensor 52 operates in the escrow mode with the position sensing LED 58 in the ON state and the bar-code LED 54 in the OFF state (step 150). When a customer inserts a document, such as a bar-coded coupon or a one-dollar bill, into the entryway 8, one or both LEDs associated with the start sensors 40, 42 become occluded (step 152), and the microcontroller 72 initializes a document recognition and/or validation process (step 154). The microcontroller 72 clears or resets various memory buffers and controls the transport motor 18 to move the document along the passageway 9 in the direction of the arrow 28 (step 156). At this point in the process, the sensor 52 remains in the escrow mode, and the front optical recognition sensors 44–50 are turned on. As the document moves further along the passageway 9, the optical recognition sensors 44–50 obtain measurements of the light transmitted through the document (step 158). Measurements of the light transmission characteristics of the document can be used, for example, to determine whether the document is an authentic banknote and, if authentic, the denomination of the banknote. Document validation measurements are taken until the document clears the front optical sensors 44–50.

As the document continues to move along the passageway 9, the leading edge of the document reaches a first selected position indicated by line 120 in FIG. 3. The selected position 120 can be either a predetermined position or a calculated position based, for example, on the length of the inserted document 29. In the illustrated implementation, the position 120 is directly above the prism 60 and directly below the position sensing LED 58 and the optical receiver 56. As the leading edge of the document intersects the path of light from the position sensing LED 58 to the optical receiver 56, the amount of light sensed by the optical receiver is reduced such that the optical receiver no longer is saturated (step 160). The microcontroller 72 recognizes the changed state of the optical receiver 56 and interprets the changed state as an indication that the leading edge of the document has reached the position 120 in the passageway 9 (step 162). The microcontroller 72 then controls the sensor 52 to operate in the bar-code sense mode, with the position sensing LED 58 in the OFF state and the bar-code LED 54 in the ON state (step 164).

The recognition sensors 44–50 continue to obtain measurements of the light transmitted through the document as in step 158. Additionally, with the sensor 52 operating in the bar-code sense mode, the optical receiver 56 senses optical signals from the bar-code LED 54 that are reflected from the upper surface of the document as it travels along the passageway 9 (step 166). As the document continues to move along the passageway 9, the trailing edge of the document eventually is sensed by the start sensors 40, 42 (step 168). The microcontroller 72 recognizes the changed signal from the start sensors and turns off the LEDs associated with the recognition sensors 44–50 (step 170). The sensor 52 continues to obtain data that can be used to analyze a bar-code or other pattern (if any) on the document.

When the trailing edge of the document passes the start sensors 40, 42, the transport motor 18 remains turned on to move the document an additional calculated or predetermined distance along the passageway 9 (step 172). The calculated or predetermined distance is selected so that, after moving the predetermined distance, the trailing edge of the document will be located in the passageway at a point just before the selected position (line 120 in FIG. 3). In the illustrated implementation, for example, the distance is slightly less than about three inches. The microcontroller can determine when the document has moved that distance based on the signals from the tachometer 97. Once the document has moved the calculated or predetermined distance, the sensor 52 again is operated in the escrow mode, with the position sensing LED 58 turned ON and the bar-code LED 54 turned OFF (step 174).

With the sensor 52 operating in the escrow mode, the motor 18 continues to move the document along the passageway 9 until the trailing edge of the document reaches the position 120. When the output signal from the optical receiver 56, as interpreted by the microcontroller 72, indicates that the trailing edge of the document has reached and passed the position 120 (step 176), the motor 18 is turned off (step 178). When the trailing edge of the document is located just beyond the position 120 and the motor 18 is turned off, the document is in an escrow position. The document is gripped by the tractor belts 10 and transport belts 24 in case the motor 18 is to be reversed and the document rejected.

While the document is stopped in the escrow position, the data obtained from the recognition sensors 44–50 is analyzed to determine whether the document is a genuine banknote, and, if genuine, the denomination of the banknote (step 180). Any of several techniques can be used to validate the document as a genuine banknote. Examples of such techniques include those disclosed in U.S. Pat. Nos. 4,628,194; 5,167,313; 5,330,041; 5,443,144; and 5,564,548 which are assigned to the assignee of the present invention and are incorporated by reference herein. Other techniques also can be used. If the document is recognized as a genuine banknote, for example, a one-dollar bill, then the process continues with step 186.

If the document is not recognized as a genuine banknote based on the data obtained from the recognition sensors 44–50, then the microcontroller 72 decodes the data obtained from the optical receiver 56 while the sensor 52 was operating in the bar-code sense mode (step 182). The decoded data is sent to the host system via the interface 76 to determine whether the document includes a predetermined pattern and whether the document should be accepted. In one implementation, the data from the sensor 56 is analyzed to determine whether the document includes a predetermined bar-code pattern. Any one of several techniques can be used to analyze the data based on the signals from the bar-code LED 54. Examples of such techniques include those disclosed in U.S. Pat. No. 4,782,220 which is assigned to the assignee of the present invention and is incorporated by reference herein. Other techniques also can be used. Moreover, where the unit is designed to validate and accept documents having one of several possible bar-code or other patterns, the predetermined pattern can be any one of those possible patterns. The host system sends a signal to the microcontroller 72 indicating whether the document is to be accepted or rejected.

If the document is recognized as a genuine bar-coded coupon, then the process continues with step 186. If, however, the document also is not recognized as a genuine bar-coded coupon, then the motor 18 is reversed and the document ejected through the entryway 8 (step 184).

In some implementations, steps 180 and 182 are reversed so that the data obtained from the sensor 52 while operated in the bar-code sense mode is analyzed first and subsequently the data obtained from the recognition sensors 44–50 is analyzed.

If the document is recognized as either a genuine banknote or a genuine bar-coded coupon, then the sensor 52 is controlled to operate in the anti-cheat mode (step 186) with the bar-code LED 54 in the OFF state and the position sensing LED 58 in the ON state. The transport motor 96 is turned on and the document is moved along the passageway 9 toward the stacker 2 in the direction of the arrow 25 in FIG. 2 (step 188). The document continues to move toward the stacker 2 until the trailing edge of the document is sensed by the sensor 70, at which point the motor 96 is turned off (step 190). The document then is stored in the cashbox 4 (step 192).

Once the stacker home sensor 98 indicates that the document has been stacked and stored successfully in the cashbox 4, credit is given to the customer to allow a purchase to be made (step 194). The system 1 then returns to the idle state (step 150).

While the sensor 52 is operating in the anti-cheat mode, changes in the signals from the optical receiver 56 are converted to digital state transitions, and the microcontroller 72 monitors the converted signals on an interrupt line, such as the interrupt line 109 (step 196). In one implementation, when the sensor 52 is operated in the anti-cheat mode, signals from the optical receiver 56 are sent to the discrimination circuitry 108 which converts changes in the analog signals to pulses, as previously described. The pulses can be used to trigger the interrupt line 109.

Figure 13:
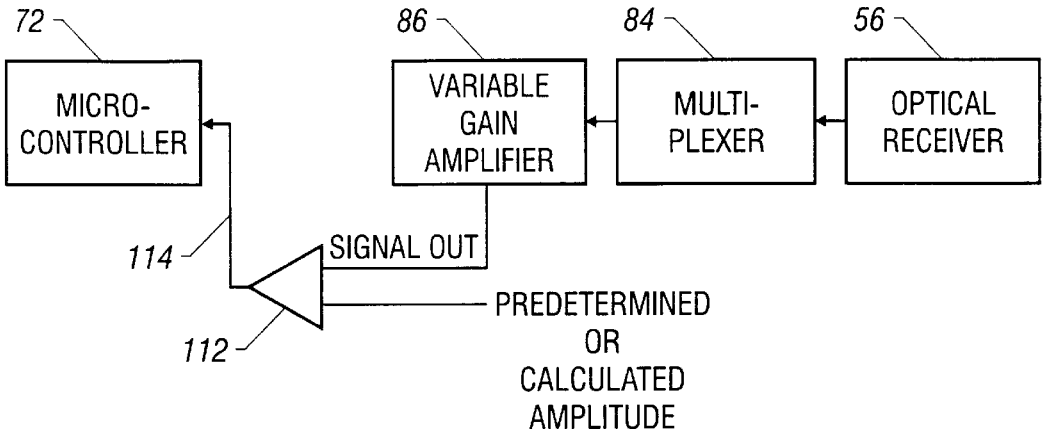
FIG. 13 illustrates an alternative technique for monitoring an output of the multi-function sensor when operated in an anti-cheat mode.

Alternatively, when the sensor 56 is operated in the anti-cheat mode, analog signals from the optical receiver 56 can be converted to digital state transitions by sending the analog signals through the multiplexer 56 and the variable gain amplifier 86. The output signals from the variable gain amplifier 86 then would serve as an input to a comparator 112 (FIG. 13) which compares the input to a fixed amplitude. The fixed amplitude can be either a predetermined amplitude or a calculated amplitude. The output of the comparator 112 then would be sent to the microcontroller 72 via an interrupt line 114.

If an accepted document is being transported properly toward the stacker 2 for storage in the cashbox 4, the output from the optical receiver when operated in the anti-cheat mode should be substantially constant. That is because the document would be moving away from the sensor 52 and would not intersect light transmitted from the position sensing LED 58 to the optical receiver 56 via the prism 60. On the other hand, if a customer attempts to retrieve the document, for example, by attaching a string to the document and pulling the document toward the entryway 8, the output of the optical receiver 56 will change significantly as the document intersects the path of light transmitted from the position sensing LED 58.

By monitoring the interrupt line 109 (or 114) when the sensor 52 is operated in the anti-cheat mode, the microcontroller 72 can detect significant changes in the output of the optical receiver 56. The microcontroller interprets such significant changes as an attempt to cheat the system 1 (step 198) and reverses the motors to eject the document through the entryway 8 (step 200). Alternatively, the document can be stacked in the cashbox 4, but the customer will not be given credit. The system 1 then returns to the idle state (step 150).

The position sensing LED 58 also can be used to detect other events occurring in the bill path 9. For example, when power to the validator and transport unit 1 initially is turned ON, the position sensing LED 58 can be turned ON as well. If the output of the sensor 56 indicates that a document is located in the document path immediately after the power is turned ON, the microcontroller 72 interprets the signals received from the sensor as indicating that a document is jammed in the validator. A jam recovery software routine then can be executed or other appropriate steps performed.

The microcontroller 72 is programmed with software to execute the foregoing functions.

Figure 14A:
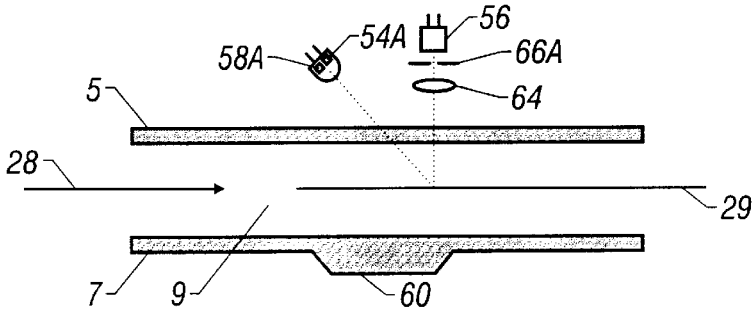
FIGS. 14A–14B are cross-sectional views of a second embodiment of a multi-function sensor according to the invention.
Figure 14B:
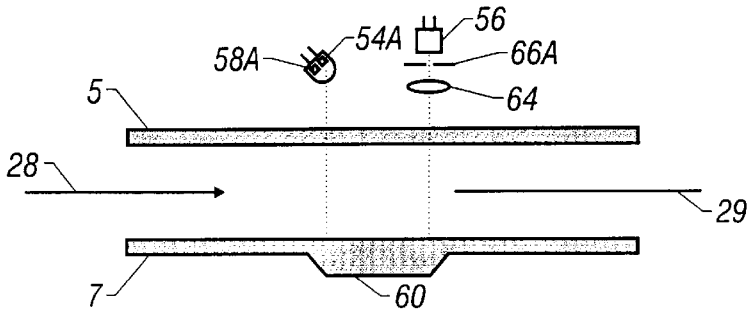

Although the optical sensor 52 has been described as having two discrete emitting devices 54, 58, the bar-code LED and the position sensing LED can be formed as a single integrated light emitting device which includes two light emitting components 54A, 58A (FIGS. 14–15). In one such embodiment, the light emitting component 54A emits light in the visible range and serves the functions of the bar-code LED 54. As a document 29 passes in the vicinity of sensor, light from the light emitting component 54A reflects off the surface of the document and is sensed by the optical receiver 56 (FIG. 14A). Similarly, the light emitting component 58A emits infrared light and serves the functions of the position sensing LED 58. As a document approaches the sensor, it intersects the path of light which is transmitted across the document path 9, reflected by the prism 60A, and sensed by the optical receiver 56 (FIG. 14B). The half angle of the integrated light emitting device should be large enough to accommodate both the transmissive and reflective paths of light. A slit 66A which is transparent to infrared light can be placed between the lens 64 and the optical receiver 56. Electrical signals from the optical receiver 56 can be used as described above, depending on the mode in which the sensor is operated.

Figure 15A:
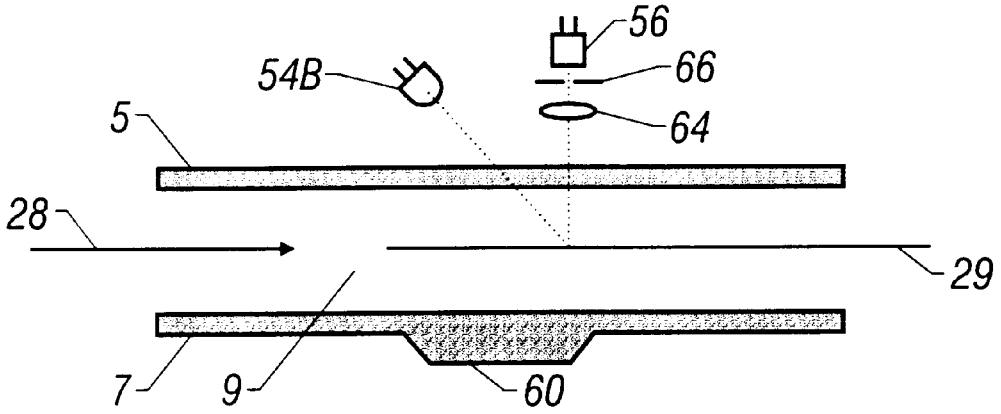
FIGS. 15A–15B are cross-sectional views of a third embodiment of a multi-function sensor according to the invention.
Figure 15B:
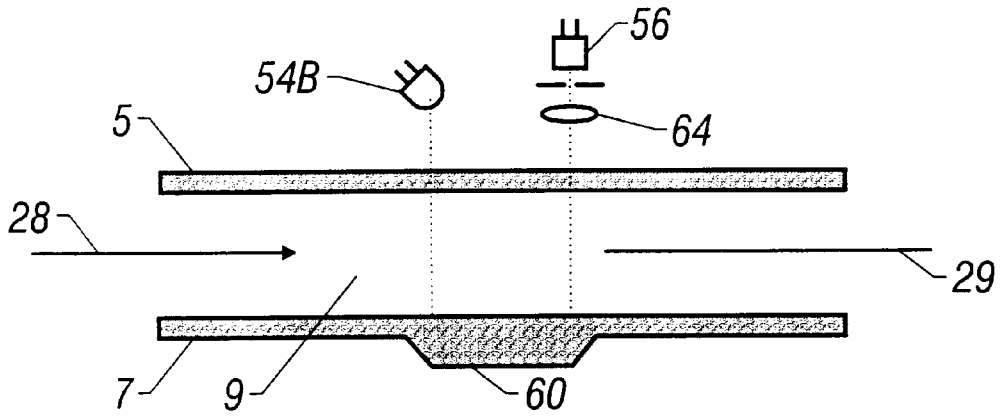

According to a further embodiment, the bar-code LED 54 and the position sensing LED 58 can be formed as a single light emitting device 54B (FIGS. 15A–15B). Again, the half angle of the single LED 54B must be sufficiently large to accommodate both the transmissive and reflective paths of light. The brightness of the light emitting device 54B can be controlled depending on the mode in which the sensor 52 is operated, and electrical signals from the optical receiver 56 can be used as described above, depending on the mode in which the sensor is operated.

Figure 16:
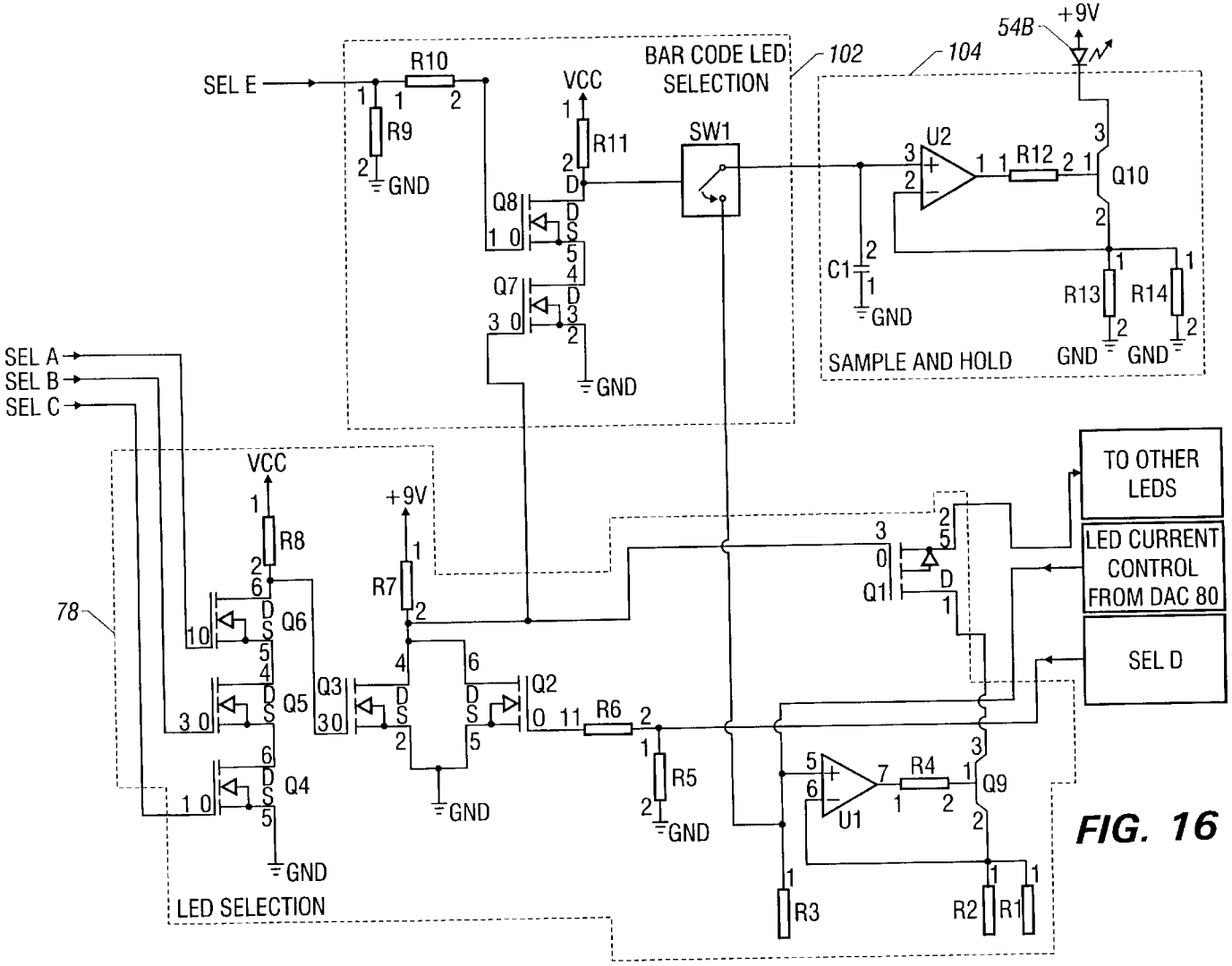
FIG. 16 is a partial circuit diagram for controlling the multi-function sensor of FIGS. 15A–15B.

If the sensor 52 includes only the single LED 54B, then the circuitry shown in FIG. 8 can be modified to as shown in FIG. 16. Specifically, the position sensing LED 58 and the bar-code LED 54 are replaced by the single light emitting device 54B which is coupled to the output of the sample and hold circuit 104. When the switch SW1 is closed or in its downward position, the current provided to the LED 54B depends on the present value from the DAC 80. That configuration can be used in either the escrow or anti-cheat modes. When the switch SW1 is open or in its upward position, the current provided to the LED 54B is set by the energy stored by the capacitor C1. That configuration can be used in the bar-code sense mode.

Other implementations are within the scope of the following claims.

What is claimed is:

1. A document acceptor comprising:

a document transport path;

an optical sensor disposed adjacent the transport path, wherein the optical sensor includes at least first and second light emitting devices and an optical receiver, wherein the optical receiver receives optical signals originating from the first light emitting device when the sensor is operated in a first mode, and wherein the optical receiver receives optical signals originating from the second light emitting device when the sensor is operated in a second mode; and a controller for controlling the sensor to operate in at least either the first mode or the second mode and for processing signals based on an output from the sensor, wherein when the sensor is operated in the first mode electrical signals originating from the optical receiver are used to determine an absence or presence of the document at a position along the path, and wherein when the sensor is operated in the second mode electrical signals originating from the optical receiver are indicative of whether the document includes a predetermined pattern.

2. The acceptor of claim 1 wherein the second light emitting device and the optical receiver are disposed on a first side of the document transport path and are configured so that when the sensor is operated in the second mode and a document travels along the path in a vicinity of the sensor, optical signals originating from the second light emitting device are reflected by the document and sensed by the optical receiver.

3. The acceptor of claim 2 wherein the second light emitting device is inclined at an angle with respect to the document transport path.

4. The acceptor of claim 1 further including a prism, wherein the optical receiver and the first light emitting device are disposed on a first side of the document transport path, the prism is disposed on a second side of the path, and wherein the first light emitting device, the prism and the optical receiver are configured so that when the sensor is operated in the first mode, optical signals originating from the first light emitting device are transmitted across the document transport path, reflected by the prism and sensed by the optical receiver.

5. The acceptor of claim 4 wherein the prism includes a trapezoidal shaped cross section.

6. The acceptor of claim 1 wherein the first and second light emitting devices emit light at different wavelengths from one another.

7. The acceptor of claim 6 wherein the first light emitting device emits red light and the second light emitting device emits infrared light.

8. The acceptor of claim 1 further including a prism, wherein the optical receiver and the first and second light emitting devices are disposed on a first side of the document transport path, wherein the prism is disposed on a second side of the path, and wherein the light emitting devices, the prism and the optical receiver are configured so that when the sensor is operated in the first mode, optical signals originating from the first light emitting device are transmitted across the document transport path, reflected by the prism and sensed by the optical receiver, and when the sensor is operated in the second mode and a document travels along the path in a vicinity of the sensor, optical signals originating from the second light emitting device are reflected by the document and sensed by the optical receiver.

9. The acceptor of claim 1 wherein when the sensor is operated in the first mode, the controller uses electrical signals originating at the optical receiver to sense an edge of the document.

10. The acceptor of claim 9 wherein when the sensor is operated in the first mode, the controller uses electrical signals originating at the optical receiver to sense a leading edge of the document.

11. The acceptor of claim 9 wherein when the sensor is operated in the first mode, the controller uses electrical signals originating at the optical receiver to sense a trailing edge of the document.

12. The acceptor of claim 1 wherein when the sensor is operated in the first mode, an amplitude of light emitted by the first light emitting device saturates the optical receiver in the absence of a document intersecting an optical path from the first light emitting device to the optical receiver.

13. The acceptor of claim 12 wherein when the sensor is operated in the first mode and a document intersects the optical path from the first light emitting device to the optical receiver, the sensor is no longer saturated.

14. The acceptor of claim 1 wherein when the sensor is operated in the first mode, the second light emitting device does not emit light.

15. The acceptor of claim 1 wherein when the sensor is operated in the second mode, the first light emitting device does not emit light.

16. The acceptor of claim 1 further including:

circuitry for selectively controlling either the first or the second light emitting devices to emit light at an amplitude in response to control signals from the controller, wherein the circuitry includes a sample and hold circuit coupled to the second light emitting device.

17. The acceptor of claim 16 further including a digital-to-analog converter having inputs coupled to the controller, and having an output coupled to the sample and hold circuit when the second light emitting device is selected to emit light, wherein signals provided to the digital-to-analog converter by the controller control the amplitude of light to be emitted by the second light emitting device.

18. The acceptor of claim 1 further including:

pattern discrimination circuitry coupled to the controller for processing electrical signals originating at the optical receiver when the sensor is operated in the second mode.

19. The acceptor of claim 18 wherein the pattern discrimination circuitry converts amplitude changes in an electrical signal originating at the optical receiver to one or more pulses.

20. The acceptor of claim 19 wherein the pattern discrimination circuitry includes a clocked differentiator.

21. The acceptor of claim 19 wherein the pulses correspond to transitions in a pattern on a document travelling along the document transport path.

22. The acceptor of claim 21 wherein the pattern on the document is a bar-code pattern.

23. The acceptor of claim 19 further including a closed-loop feedback circuit for sampling analog output signals from the optical receiver, wherein the controller uses the sampled signals to adjust a brightness of the second light emitting device when the sensor is operated in the second mode.

24. The acceptor of claim 1 further including a document storage location and an entryway, wherein the controller can control the optical sensor to operate in a third mode in which the optical receiver receives optical signals from the first light emitting device, and wherein when the sensor is operated in the third mode electrical signals from the optical receiver are used to determine whether the document is moving away from the storage location toward the entryway.

25. The acceptor of claim 24 further including an interrupt line coupled to the controller, wherein when the sensor is operated in the third mode, signals on the interrupt line that are based on signals from the optical receiver are indicative of whether the document is moving along the transport path away from the storage location toward the entryway.

26. The acceptor of claim 25 further including circuitry coupled between the optical receiver and the interrupt line for converting amplitude changes in electrical signals from the optical receiver to one or more pulses when the sensor is operated in the third mode.

27. The acceptor of claim 26 wherein the circuitry includes a clocked differentiator.

28. The acceptor of claim 25 further including a comparator coupled between the interrupt line and the optical receiver for comparing a signal based on an output of the optical receiver to a fixed amplitude.

29. A document acceptor comprising:

a document transport path;

an optical sensor disposed adjacent the document transport path, wherein the optical sensor includes a light emitting device and an optical receiver;

a controller for operating the sensor in at least either a first mode or a second mode and for processing signals based on an output from the sensor;

wherein when the sensor is operated in the first mode electrical signals originating from the optical receiver are used to determine an absence or presence of the document at a position along the path, wherein when the sensor is operated in the second mode electrical signals originating from the optical receiver are indicative of whether the document includes a predetermined pattern, and wherein signals from the controller determine an amplitude of light to be emitted by the light emitting device, wherein the amplitude of light depends on whether the sensor is to be operated in the first mode or second mode.

30. The acceptor of claim 29 further including:

a sample and hold circuit having an output coupled to the light emitting device; and a digital-to-analog converter having inputs coupled to the controller, and having an output which can be coupled selectively to the sample and hold circuit, wherein signals provided to the digital-to-analog converter by the controller control the amplitude of light to be emitted by the light emitting device.

31. The acceptor of claim 29 wherein when the sensor is operated in the first mode, an amplitude of light emitted by the light emitting device saturates the optical receiver in the absence of a document intersecting an optical path from the light emitting device to the optical receiver.

32. The acceptor of claim 31 wherein when the sensor is operated in the first mode and a document intersects the optical path from the light emitting device to the optical receiver, the sensor is no longer saturated.

33. The acceptor of claim 29 wherein when the sensor is operated in the first mode, the controller uses electrical signals originating at the optical receiver to sense an edge of the document.

34. A document acceptor comprising:

a document transport path;

an optical sensor disposed adjacent the document transport path, wherein the optical sensor includes a light emitting device and an optical receiver;

a controller for operating the sensor in at least either a first mode or a second mode and for processing signals based on an output from the sensor;

first processing circuitry coupling an output of the sensor to the controller and which processes electrical signals originating at the optical receiver when the sensor is operated in the first mode; and second processing circuitry coupling an output of the sensor to the controller and which processes electrical signals originating at the optical receiver when the sensor is operated in the second mode, wherein the second processing circuitry includes pattern discrimination circuitry that includes a clocked differentiator and converts amplitude changes in an electrical signal originating at the optical receiver to one or more pulses;

wherein when the sensor is operated in the first mode electrical signals originating from the optical receiver are used to determine an absence or presence of the document at a position along the path, and wherein when the sensor is operated in the second mode electrical signals originating from the optical receiver are indicative of whether the document includes a predetermined pattern.

35. A document acceptor comprising:

an entryway through which a document is inserted;

a document storage location;

a document transport path for transporting a document inserted through the entryway toward the storage location;

an optical sensor disposed adjacent the document transport path, wherein the optical sensor includes a light emitting device and an optical receiver;

a controller for operating the sensor in at least either a first mode, a second mode or a third mode and for processing signals based on an output from the sensor;

an interrupt line coupled between the optical sensor and the controller;

wherein when the sensor is operated in the first mode electrical signals originating from the optical receiver are used to determine an absence or presence of the document at a position along the path, wherein when the sensor is operated in the second mode electrical signals originating from the optical receiver are indicative of whether the document includes a predetermined pattern, and wherein, when the sensor is operated in the third mode, signals on the interrupt line that are based on signals from the optical receiver are indicative of whether the document is moving along the transport path away from the storage location toward the entryway.

36. A method of accepting a document, the method comprising:

causing the document to move along a transport path;

sensing a leading edge of the document as it moves along the path using an optical sensor operating in a first mode;

controlling the optical sensor to operate in a second mode after the leading edge of the document is sensed, wherein during the second mode, the sensor primarily uses light in a frequency range substantially different from a frequency range of light used during the first mode; and obtaining data indicative of whether the document includes a predetermined pattern based on signals sensed by the optical sensor while operating in the second mode.

37. The method of claim 36 wherein sensing further includes transmitting light from a first light emitting device across the document transport path and reflecting the transmitted light back across the document transport path.

38. The method of claim 36 wherein sensing includes operating a first light emitting device at an amplitude that saturates an optical receiver when the document does not intersect a path of the light from the first light emitting device.

39. The method of claim 38 wherein sensing further includes operating the first light emitting device at an amplitude that does not saturate the optical receiver when the document intersects the path of light from the first light emitting device.

40. The method of claim 39 wherein obtaining data further includes reflecting the optical signal of a second light emitting device off the document.

41. The method of claim 36, wherein sensing the leading edge includes providing an optical signal from a first light emitting device operating at a first wavelength and wherein obtaining data includes providing an optical signal from a second light emitting device operating at a second wavelength, wherein the method further includes:

sampling analog output signals from the optical receiver; and using the sampled signals to adjust a brightness of the second light emitting device when the sensor is operated in the second mode.

42. The method of claim of claim 36 wherein sensing the leading edge includes:

providing a first optical signal from a first light emitting device; and transmitting the first optical signal across the document transport path and reflecting the transmitted optical signal back across the document transport path.

43. The method of claim 42 wherein obtaining data includes:

providing a second optical signal from a second light emitting device; and reflecting the second optical signal off the document.

44. The method of claim 36 further including:

controlling the optical sensor to operate in the first mode after performing the step of obtaining data;

sensing a trailing edge of the document using the optical sensor operating in the first mode; and holding the document in a selected position in the document transport path after sensing the trailing edge; and analyzing data obtained while the document travelled along the document transport path to determine whether the document is a genuine document.

45. The method of claim 44 wherein analyzing data includes analyzing the data obtained by the optical sensor while operating in the second mode.

46. The method of claim 44 further including:

controlling a motor to transport the document toward a storage location if the document is determined to be genuine; and controlling the optical sensor to operate in an anti-cheat mode while the document is transported toward the storage location.

47. The method of claim 46 further including:

obtaining electrical signals originating at the sensor while operated in the third mode; and using the signals obtained while the sensor is operated in the third mode to determine whether the document is moving away from the storage location.

48. The method of claim 47 further including:

reversing the motor if it is determined that the document is moving away from the storage location; and ejecting the document.

49. A method of accepting a document, the method comprising:

causing the document to move along a transport path;

sensing a leading edge of the document as it moves along the path using an optical sensor operating in a first mode;

controlling the optical sensor to operate in a second mode after the leading edge of the document is sensed, wherein a brightness of light associated with the sensor is adjusted depending on the mode in which the sensor is operated; and obtaining data indicative of whether the document includes a predetermined pattern based on signals sensed by the optical sensor while operating in the second mode.

* * * * *